United States Patent [19]

Ware

[11] 3,961,891

[45] June 8, 1976

[54] ANTIBACTERIAL LAUNDRY OIL AND DUST CONTROL OIL COMPOSITION

[75] Inventor: Richard E. Ware, Aston, Pa.

[73] Assignee: Sun Oil Company of Pennsylvania, Philadelphia, Pa.

[22] Filed: Dec. 6, 1974

[21] Appl. No.: 530,475

[52] U.S. Cl. ..... 8/142; 106/15 R; 252/88; 252/400 R; 428/291

[51] Int. Cl.[2] ..... B08C 3/00

[58] Field of Search ..... 252/88, 400; 8/142, 8/137; 428/291; 106/15

[56] References Cited

UNITED STATES PATENTS 2,709,665 6/1955 Campbell et al..... 252/88

3,577,215 5/1971 Impullitti ..... 252/88

OTHER PUBLICATIONS

Povnick & Fabian, Chem. Abstract, vol. 47: 1953.

Huttenlocker & Kaufmann, Chem. Abstract, vol. 54–1960.

*Primary Examiner*—William J. Van Balen

*Assistant Examiner*—James J. Bell

*Attorney, Agent, or Firm*—J. Edward Hess; Donald R. Johnson; Anthony Potts, Jr.

[57] ABSTRACT

A laundry oil contains 0.0001 to 0.10 weight percent phenyl mercury oleate as an antibacterial agent. Also disclosed is the process of laundering fabrics used to wipe dust with such an oil and a concentrate for adding to an oil prior to its use as a laundry oil.

7 Claims, No Drawings

ANTIBACTERIAL LAUNDRY OIL AND DUST CONTROL OIL COMPOSITION

CROSS REFERENCE TO RELATED APPLICATIONS

Subject matter of this application is related to applicant's U.S. applications Ser. No. 292,054, filed Sept. 25, 1972, now U.S. Pat. No. 3,915,877 and Ser. No. 461,070, filed Apr. 15, 1974.

BACKGROUND OF THE INVENTION

The present invention relates to a new laundry oil composition containing a bactericide which is suitable for use in a combination oiling-laundering process, the process of laundering fabrics with this new laundry oil composition and the fabrics impregnated with the new laundry oil composition. Also, the invention relates to a concentrate containing the bactericide which can be added to naphthenic or paraffinic oil prior to the oil's use as a laundry oil.

U.S. Pat. No. 3,740,190 discloses the use of 0.02 to 2.0 percent benzyl bromo-acetate as an antibacterial agent for laundry oil. U.S. Pat. No. 3,740,191 discloses the use of 0.015 to 2.0 percent of 1,2 benzisothiazalone as an antibacterial agent for the same purpose. The aforementioned U.S. applications disclose the use of 0.02 to 2.0 percent of 8-hydroxyquinoline with laundry oils.

DESCRIPTION OF THE INVENTION

Fabrics conventionally impregnated with oil to aid in collecting dust include dust mops, dust cloths and walk-off rugs or mats. These fabrics are impregnated with oil so that when they pass over a surface they will pick up and retain the dust and dirt on that surface. While there is little possibility of redepositing the dirt from one surface onto another surface being cleaned, there is a chance that the microorganisms might be transferred. To deter such a transfer a bactericide is incorporated into the oil composition. There is almost always some moisture adsorbed on the surface of the dirt particles and it is this aqueous medium which contains microorganisms. Therefore, it is important that there be a migration from the oil impregnant in a dust control fabric to this aqueous phase in order to kill such microorganisms. Thus the laundry oil must contain within itself a miscible component which can effectively migrate to the hydrous dirt particles. Some antibacterial agents have been found to impart antibacterial activity to an oil for this type of application.

It should be pointed out that oil alone reduces growth of most bacteria because it isolates them from their nutrient sources in the aqueous phase and also extracts vital components from their structures. However, the present invention is not concerned about such passive destruction of bacteria but rather a composition which actively destroys bacteria in dirt or aqueous phases in contact with oil. Thus when a disc of fabric impregnated with the oil composition of the present invention is placed on a nutrient medium having a bacteria culture growing thereon the bacteria are killed not only under the disc of fabric but also in a ring around the fabric disc which ring is several mm. wide. This is known as bacteriostatic activity. Many of the usual bactericides such as ortho-phenyl phenol have been found to be ineffective for the present purpose in the concentrations desired. The salts of these compounds, such as sodium o-phenylphenate, would enhance bacteriostatic activity, but the metal salts are immiscible in hydrocarbon oils. The bactericide also must not give off noxious fumes because the operator removing the fabrics from the processing equipment will be exposed to such fumes. The formaldehyde, although it is quite active, is unsatisfactory. Until recently it was believed that phenyl mercury oleate was too toxic to man for such a use.

It has now been found that phenyl mercury oleate may not be too toxic for laundry oil use because it is surprisingly effective at such minute quantities. Also, because of its solubility in oil it can be incorporated in a concentrate. A concentrate has an economical advantage in that the antibacterial agent can be added to a laundry oil at the cleaning plant, rather than requiring first shipment of the oil from a refinery to a blending plant where the agent is blended with the oil and then a second shipment of the blended oil to the cleaning plant. Such duplication of shipping wastes energy and contributes to inflation.

The phenyl mercury oleate can be used in amounts of from about 0.0001 to 0.10 weight percent based on the total composition of the laundry oil used to treat fabrics. It's structure is as follows:

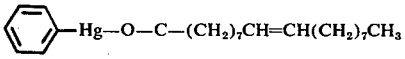

The oleate could also be in a concentrate consisting of several compounds. These compounds serve individually as a dispersant, an antioxidant and an odorant. In such a concentrate the oleate would be present in amounts of from about 0.005 to 5.0 weight percent based on the total composition. This is equivalent to a mercury concentration of 0.002 to 2. weight percent.

The base oils of the present invention are mineral oils and can be either paraffinic or naphthenic. Generally they have a viscosity of from 60 to 600 SUS at 100°F., with from 100 to 300 SUS at 100°F. being preferred.

Preferably the laundry oil of the present invention contains a dispersant to assist in removing aqueous soil from the dirty articles being cleaned. Generally the preferred dispersants are salts of alkyl sulfonates or salts of alkyl benzene sulfonates. In either case the molecular weight generally is from 300 to 600. The alkali metal salts are preferred. Generally from 0.5 to 3.0 percent as based on the total composition of the dispersant is used.

The laundry oil preferably contains an antioxidant in an amount of from 0.01 to 0.5 percent as based on the total composition. Butylated hydroxy toluene is a preferred antioxidant.

The composition of the present invention, that is the composition containing 0.0001 to 0.10 weight percent of oleate, is also useful as an oil fabric impregnant.

EXAMPLE I

A sample of oil was prepared containing 97.7 weight percent of a nonstaining naphthenic mineral oil having a viscosity of 104 SUS 100°F. and 38 SUS 210°F; 2.0 weight percent sodium alkyl aryl sulfonates, 0.1 weight percent "Alpine 16951" odorant and 0.1 weight percent butylated hydroxyl toluene. Phenyl mercury oleate was added at two levels, 0.03 weight percent and 0.003 weight percent. The samples tested for bacteriostatic activity on both *E. Coli* (gram +) and *S. Aureus* (gram −) in accordance with AATCC90-1965, which is an agar plate test developed by the American Association of Textile Chemists and Colorants.

The laundry oil may also contain an odorant to impart a fresh clean smell thereto. "Alpine 16951", a complex mixture of essential oils and aromatics supplied by Alpine Aromatics, Inc. of Metuchen, N.J. is exemplary of preferred odorants. Generally about 0.05–0.2 weight percent as based on the total composition is used. Although odorants are conventionally used in this type of oil their use may be omitted depending upon personal preferences or economics.

A concentrate would contain a dispersant in an amount of from about 0 to 75%; an antioxidant in an amount of from about 0.5% to 25 %; an odorant in an amount of from about 0 to 25%; and the oleate in an amount of from about 0.005% to about 5%; all amounts are based on weights. The balance is either a paraffinic or naphthenic oil. One gallon of concentrate would be sufficient to prepare 50 gallons of laundry oil. A typical concentrate would contain 40 weight percent of a dispersant such as sodium sulfonate, 5 weight percent of an antioxidant such as butylated hydroxyl toluene, 5 weight percent of an odorant, 0.1 weight percent of phenyl mercury oleate and 49.9 weight percent of Sunthene 410, a hydrogenated naphthenic oil.

At the 0.03 weight percent level the oleate as the antibacterial agent in the laundry oil composition had a clear zone of 15.5 mm on *E. Coli* and 21.5 on *S. Aureus;* at a 0.003 weight percent level it had a clear zone of 10.5 mm on the former and 12.5 mm on the latter.

EXAMPLE II

Fifty dirty mops are charged to a conventional laundry wheel having a 150 lb. capacity which is connected by piping to an oil reservoir, an oil filter and a heat exchanger. Clean warm oil (165°F.) is continuously circulated from the reservoir into the laundry wheel containing the dirty mops and then through the filter back to the reservoir at a rate of 10 g. per min. while the laundry wheel is operated. The oil level is half way up in the laundry wheel. The oil is the one described in Example I and contains 0.003 weight percent of the oleate. After 30 minutes the oil is pumped out of the laundry wheel without recirculating it. The mops are then spun "dry" for 12 minutes and then are manually unloaded from the apparatus. The cleaned mops contain 35 to 40 weight percent oil but are dry to the touch and appear in excellent condition.

The invention claimed is:

1. A dust control fabric impregnated with a composition comprising a major portion of a naphthenic or paraffinic oil and from about 0.0001 to 0.10 weight percent of phenyl mercury oleate, said percent based on total weight of composition.

2. The fabric of claim 1 wherein the fabric is in the form of a mop.

3. The fabric of claim 1 wherein the fabric is in the form of a walk-off mat.

4. In the process of laundering dust control fabric wherein the fabric is immersed in a composition of a laundry oil, causing a flow of the oil with respect to the fabric whereby the oil composition removes said particles from the fabric and the said particles are removed from the oil by filtration, the improvement comprising that the oil contain about 0.0001 to 0.10 weight percent of phenyl mercury oleate, said percent based on total weight of composition.

5. The process of claim 4 wherein the fabric is in the form of a mop.

6. A concentrate for adding to naphthenic or paraffinic laundry oil wherein the proportions are about:

| | |
|---|---|
| dispersant | 0 wt. % to 75 wt. % |
| antioxidant | 0.5 wt. % to 25 wt. % |
| odorant | 0 wt. % to 25 wt. % |
| phenyl mercury oleate | .005 wt. % to 5 wt. % |

and the balance is a paraffinic or naphthenic laundry oil.

7. A concentrate according to claim 6 wherein the dispersant is a sodium sulfonate and the antioxidant is butylated hydroxyl toluene.

* * * * *